US005953937A

United States Patent [19]

Corduan et al.

[11] Patent Number: 5,953,937

[45] Date of Patent: Sep. 21, 1999

[54] PROCESS AND APPARATUS FOR THE VARIABLE PRODUCTION OF A GASEOUS PRESSURIZED PRODUCT

[75] Inventors: Horst Corduan, Puchheim; Horst Altmeyer, München, both of Germany

[73] Assignee: Linde Aktiengesellschaft, Germany

[21] Appl. No.: 08/983,572

[22] PCT Filed: Jul. 18, 1996

[86] PCT No.: PCT/EP96/03175

§ 371 Date: Mar. 23, 1998

§ 102(e) Date: Mar. 23, 1998

[87] PCT Pub. No.: WO97/04279

PCT Pub. Date: Feb. 6, 1997

[30] Foreign Application Priority Data

Jul. 21, 1995 [DE] Germany ..... 195 26 785

[51] Int. Cl.[6] ..... F25J 3/04

[52] U.S. Cl. ..... 62/646; 62/654; 62/913

[58] Field of Search ..... 62/646, 649, 650, 62/654, 913

[56] References Cited

U.S. PATENT DOCUMENTS

| | | | |
|---|---|---|---|
| 2,708,831 | 5/1955 | Wilkinson | 62/913 X |
| 3,058,315 | 10/1962 | Schuftan | 62/913 X |
| 3,485,053 | 12/1969 | Grenier | 62/913 X |
| 4,529,425 | 7/1985 | McNeil | 62/913 X |
| 5,084,081 | 1/1992 | Rhode | 62/913 X |
| 5,209,070 | 5/1993 | Darredeau | 62/913 X |
| 5,252,149 | 10/1993 | Mostello et al. . | |
| 5,386,692 | 2/1995 | Laforce | 62/654 X |
| 5,412,953 | 5/1995 | Darredeau et al. | 62/654 X |
| 5,526,647 | 6/1996 | Grenier | 62/654 |

FOREIGN PATENT DOCUMENTS 1 178 006 1/1970 United Kingdom .

OTHER PUBLICATIONS

W. Rohde, "Luftzerlegungsanlage mit Wechselspeicherung für variable Sauerstofflieferung", *Linde Berichte Aus Technik Und Wissenschaft,* No. 54, pp. 18–20, 1984.

*Primary Examiner*—Christopher B. Kilner
*Attorney, Agent, or Firm*—Millen, White, Zelano & Branigan, P.C.

[57] ABSTRACT

Feed air is fed to a rectifying system (14, 15) for low-temperature separation, from which a liquid fraction (31, 32) is taken off and introduced into a first reservoir tank (33). The pressure of a variable rate of the liquid fraction (34) is increased (35). The liquid fraction (36) is evaporated under the elevated pressure by indirect heat exchange (12) and obtained as a gaseous pressurized product (37). A heat-transport medium circulates in a refrigeration cycle which has a cycle compressor (41, 42). A first partial stream (45) of the heat-transport medium (44) compressed in the cycle compressor (41, 42) is fed to the indirect heat exchange (12) to evaporate the liquid fraction (36) and is liquefied, at least in part, in the course of this. A second partial stream (59) of the heat-transport medium (44) compressed in the cycle compressor (41, 42) is expanded (43) so as to perform work. Liquefied heat-transport medium (45, 48) is buffered in a second reservoir tank (49).

15 Claims, 1 Drawing Sheet

PROCESS AND APPARATUS FOR THE VARIABLE PRODUCTION OF A GASEOUS PRESSURIZED PRODUCT

FIELD OF THE INVENTION

The invention relates to a process and an apparatus for the variable production of a gaseous pressurized product by low-temperature separation of air by means of pressure elevation in the liquid state and subsequent evaporation.

BACKGROUND OF THE INVENTION

The method of pressurizing a liquid product of an air separator and then evaporating it is frequently also termed "internal compression". Processes of this type have long been known for the production of a constant rate of a pressurized gas (for example DE-C-752439) and offer the advantage of lower apparatus costs in comparison with the gaseous product compression.

"Alternating reservoir processes" having at least two reservoir tanks are likewise known, in which variable rates of an atmospheric gas can be produced under atmospheric pressure and, nevertheless, steady-state operation of the rectification is possible (see, for example, W. Rohde, Linde-Berichte aus Technik und Wissenschaft, 54/1984, pages 18 to 20).

The publications DE-B-1056633, EP-A422974, EP-A-524785 and EP-A-556861 indicate processes which combine internal compression and alternating reservoir storage by buffering in reservoir tanks both the liquid product to be evaporated and the heat-transport medium (air or nitrogen) liquefied in the evaporation. The problem of the varying requirement of heat-transport medium for the evaporation of the liquid product is solved in DE-B-1056633 by expanding, so as to perform work, the respective portion of the heat-transport medium which is not required for the evaporation and discarding it. Later processes moved away from this and, instead, variable amounts of heat-transport medium are compressed (EP-A-422974, EP-A-524785 and EP-A-556861). Whereas in the first case a purified gas is lost unused, in the second case large relative fluctuations of the compressor throughput occur. The two types of plant can only be run in the respective operating mode.

The object therefore underlying the invention is to specify a process and an apparatus which can be operated as flexibly as possible and which avoid, in particular, the above-described disadvantages.

BRIEF DESCRIPTION OF THE DRAWING

The attached drawing is a schematic flow-sheet of a comprehensive embodiment of the invention.

SUMMARY OF THE INVENTION

Figure 1:
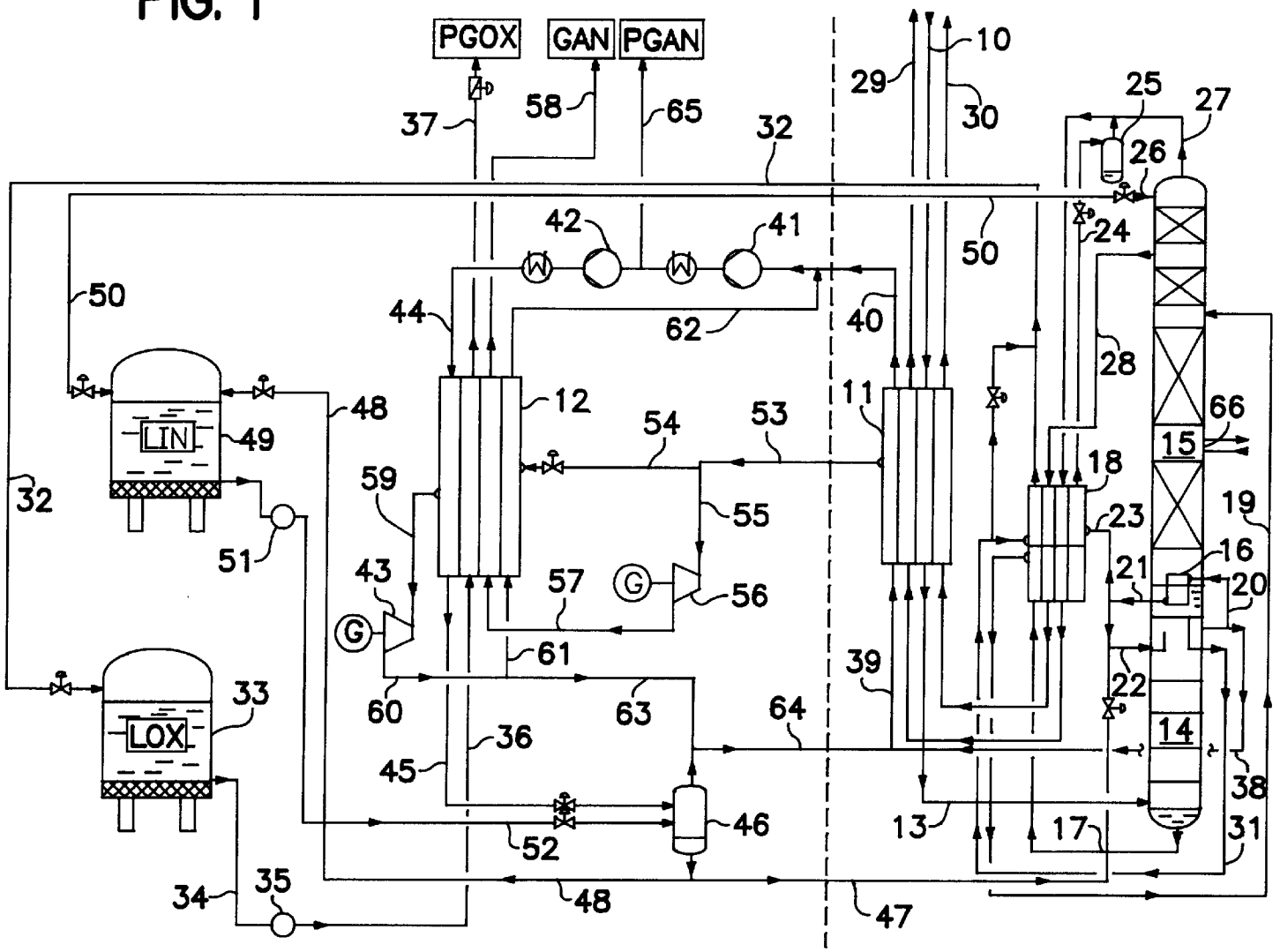

This object is achieved by the a process for the variable production of a gaseous pressurized product (3) by low-temperature separation of air, in which feed air (10, 13) is fed to a rectifying system (14, 15), a liquid fraction (31, 32, 34) from the rectifying system (14, 15) being buffered in a first reservoir tank (33), the pressure of the liquid fraction (34) being elevated (35) and a variable rate of the liquid fraction (36) being evaporated at the elevated pressure by indirect heat exchange (12) and obtained as gaseous pressurized product (37), in addition, a heat-transport medium being conducted in a refrigerating cycle which has a cycle compressor (41, 42), a first partial stream (44, 45) of the heat-transport medium compressed in the cycle compressor (41, 42) being fed to the indirect heat exchange (12) to evaporate the liquid fraction (36) and being, at least in part, liquefied, a second partial stream (44, 59) of heat-transport medium (44) compressed in the cycle compressor (41, 42) being expanded (43) so as to perform work and liquefied heat-transport medium (45, 48, 52) being buffered in a second reservoir tank (49).

The product to be produced in gaseous and pressurized form is drawn off in liquid form from the or one of the rectifying columns and buffered in a first reservoir tank. Depending on whether, at that moment, a below-average or an above-average product rate is being produced, the liquid level in the tank rises or falls. For example, the amount of liquid fraction produced in the rectification which cannot at that moment be evaporated or otherwise used (for example as liquid product) can be introduced into the tank; correspondingly, at high product demand, liquid is conducted from the tank to the evaporator. However, it is also possible to introduce the entire liquid fraction into the reservoir tank and to take off the amount actually required each time and feed to the evaporator. Under "reservoir tank" any apparatus for the storage of a liquid is to be understood. This can be an external tank with his own insulation, or another kind of vessel, which is located inside the low-temperature apparatus and capable of storing liquid.

Any known method can be employed for pressure elevation in the liquid state, for example pressurizing evaporation in the reservoir tank, utilization of a static head, pumps upstream or downstream of the reservoir tank, or else combinations of these methods. Preferably, the liquid fraction is pressurized by means of a pump arranged downstream of the tank. The throughput of this pump can be controlled in order to effect the variation of the product rate.

The process of the invention has, in addition, a refrigeration cycle having a cycle compressor and an expansion engine. A heat-transport medium, in particular a process gas of the air separator, is compressed therein, expanded so as to perform work and recycled to the cycle compressor. By means of this cycle, refrigeration is generated to compensate for insulation and exchange losses and, if appropriate, for product liquefaction.

The cycle compressor simultaneously serves to compress the heat-transport medium, which is condensed against the product to be evaporated and is buffered in a second reservoir tank (first partial stream of the heat-transport medium). The cycle compressor compresses the heat-transport medium to a pressure which corresponds to a condensation temperature which is at least about the same as the evaporation temperature of the fraction pressurized in the liquid state. At least some of the heat-transport medium compressed in the cycle compressor is returned to the cycle compressor, in particular the second partial stream, or part thereof, after it has been expanded so as to perform work. The second partial stream of the heat-transport medium compressed in the cycle compressor does not therefore need to be discarded, or not discarded completely, but is at least partially recycled. Refrigeration cycle and variable product evaporation are integrated in the invention; the same engine serves both for generation of refrigeration and for generating the pressure needed for evaporation of the liquid fraction.

Obviously, in the invention, the first partial stream is also varied in accordance with the variable product rate. However, this variation can be accomplished in different ways and thus matched flexibly to the respective actual requirements.

In a first mode of operation, with increased demand for gaseous pressurized product, the rate of the heat-transport medium compressed in the cycle compressor is kept constant. The variation of the first partial stream is made up by a corresponding variation of the second partial stream of the heat-transport medium. When the production is increased/decreased, the rate of the second partial stream is decreased/increased in the same manner as the rate of the first partial stream is increased/decreased. ("Rate" here denotes molar amounts per unit time, which can be specified in, for example, $Nm^3/h$.) The cycle compressor can thus be run at a constant rate, for example at its design capacity, and control as a function of the product rate is not necessary. An increased amount of heat-transport medium liquefied in the second partial stream is stored temporarily in the second tank; an increased gas rate in the second partial stream can be compensated for by a corresponding withdrawal of gas (for example as product) from the cycle; conversely, at below-average production, a correspondingly lower rate of gas is taken off from the cycle.

Alternatively thereto, the plant can be run in a second operating mode. In this case, the throughput of the second partial stream remains constant, while the variation in the first partial stream is followed by the cycle compressor. When there is an increased demand for gaseous pressurized product, the rate of the second partial stream is therefore kept constant and the rate of the heat-transport medium compressed in the cycle compressor is increased by the same amount as the rate of the first partial stream. Nevertheless, in the process of the invention, the relative fluctuations of the compressor throughput are comparatively small even in this operating mode, since the circulation rate can remain constant. The constant portion of the gas compressed in the cycle compressor damps the relative swings in the compressor throughput.

However, the two operating modes can also be combined, by compensating for the fluctuations in the first partial stream partly by varying the second partial stream and partly by changing the throughput of the cycle compressor. If there is an increased demand for gaseous pressurized product, not only is the rate of the heat-transport medium compressed in the cycle compressor increased, but also the rate of the second partial stream is decreased.

Depending on demand it is possible to alternate between these operating modes, for example in order to compensate for liquid product withdrawals from the tank or to supply an increased rate of liquid product(s) for a certain period. Depending on the rate of the second partial stream, different amounts of refrigeration are generated in its expansion so as to perform work.

In each case, in the process of the invention, all of the streams which are fed into the rectification column(s), or are withdrawn therefrom, can remain constant. Fluctuations in the product rate thus have no effects whatsoever on the rectification. In particular, in each operating case, consistently high purities and yields can be achieved.

If the rectifying system has a double column comprising a high-pressure column and a low-pressure column, then, for example, liquid oxygen from the bottom of the low-pressure column, or liquefied nitrogen from the high-pressure column, can be used as liquid fraction.

In an expedient embodiment, a further stream of the heat-transport medium is expanded so as to perform work. By this means, on the one hand refrigeration can be additionally generated in the cycle; on the other hand, this gives a further possibility for more precise matching of the refrigeration performance to the instantaneous demand, which is independent of the regulation of the cycle compressor and the second partial stream.

In particular, the rate of the further stream which is fed to the work-performing expansion can be decreased with increased demand for gaseous pressurized product and thus surplus refrigeration can at least partially be compensated for. Preferably, the work-performing expansion of the further stream leads from about the inlet pressure of the cycle compressor (lower level of the refrigeration cycle) to about atmospheric pressure and the further stream, expanded so as to perform work, is drawn off as unpressurized gaseous product. By this means, fluctuations ofthe amount of gas circulating in the cycle may also be made up for. In particular, for example, in the first operating mode (constant throughput at the cycle compressor), a decrease in the rate of the second partial stream can be compensated for by a corresponding decrease of the rate of the further stream which has been expanded so as to perform work. In the second operating mode (constant throughput in the work-performing expansion of the second partial stream), for example, an increase in the cycle compressor throughput can be compensated by a decrease in the gas rate which leaves the cycle as a further stream.

In principle, any process stream available in the process can be used as heat-transport medium for the refrigeration cycle and the evaporation of the liquid fraction, for example air or else another oxygen/nitrogen mixture. Preferably, however, nitrogen from the rectifying system is used as heat-transport medium, in the case of a double column, for example, gaseous nitrogen which is produced at the top of the high-pressure column. Generally, all of the cycle nitrogen is produced in the plant itself However, in addition, a partial quantity of the heat-transport medium can originate from an external source, for example by feeding liquid nitrogen from another plant or from a tanker truck into the second reservoir tank.

When nitrogen is obtained as product, the second reservoir tank, in addition to its buffer action for the variable production of pressurized product can thus also be used as an emergency store (backup) for a temporary failure of the plant and/or as a buffer for liquid product.

Moreover, the use of nitrogen as heat-transport medium has the advantage that refrigeration cycle and pressurized product evaporation have no adverse effects whatsoever on the rectification, as would be the case with feeding air liquefied against pressurized product and feeding in gaseous air from an expansion engine into a low-pressure column. The rectification can therefore be run optimally in the process of the invention using nitrogen as heat-transport medium. The process is thus also suitable for high product purities and yields, just as for producing argon subsequently to the air separation in the narrower sense (e.g. crude argon column connected to the low-pressure column of a double column).

It is expedient if the feed air for the rectifying system is cooled in a main heat exchanger system in which the liquid fraction is also evaporated at elevated pressure. By means of this integration of the heat exchange processes, the exchange losses can be kept small.

This can be effected, on the one hand, by the fact that the heat exchanger system has a heat exchanger block in which both the cooling of the feed air and also the evaporation of the liquid fraction are carried out at elevated pressure.

However, it is less complex in terms of apparatus if the main heat exchanger system has a plurality of heat exchanger blocks, in particular a first and a second heat exchanger block, the cooling of the feed air being carried out in the first heat exchanger block and the evaporation of the liquid fraction at elevated pressure being carried out in the second heat exchanger block. In this case, it is expedient if the two heat exchanger blocks are linked by a balanced stream which is taken off from one of the two heat exchanger blocks between the hot and cold end and is fed to the other of the two heat exchanger blocks between the hot and cold end.

Furthermore, the invention relates to an apparatus for the variable production of a gaseous pressurized product by low-temperature separation of air, having a rectifying system (14, 15), into which leads a feed air line (10, 13), having a liquid line (31, 32) for the withdrawal of a liquid fraction from the rectifying system (14, 15) and for its introduction into a first reservoir tank (33), having means (35) for elevating the pressure of the liquid fraction (34), having a heat exchanger (12) for evaporating the liquid fraction (36) at elevated pressure, having a product line (37) for the withdrawal of the evaporated liquid fraction as gaseous pressurized product, having a refrigeration cycle, which has a cycle compressor (41, 42), having a first partial stream line (44, 45), which is connected from the cycle compressor (41, 42) to the heat exchanger (12) to evaporate the liquid fraction (36), having a second partial stream line (44, 59), which leads from the cycle compressor (41, 42) to an expansion engine (43) and having a second reservoir tank (49) for buffering liquefied heat-transport medium (45, 48).

The invention and other details of the invention are described in more detail below with reference to the illustrative example of the Linde-VARIPOX® process (VARiable Internal Pressurization of OXygen) and to the corresponding plant, which are shown diagrammatically in the drawings.

DETAILED DESCRIPTION OF THE DRAWING

Compressed and purified feed air 10 is cooled at a pressure of 5 to 10 bar, preferably 5.5 to 6.5 bar, in the heat exchanger 11, which, together with the heat exchanger 12, forms the main heat exchanger system. The air is introduced via line 13 into a high-pressure column 14 at about dew point temperature. The high-pressure column belongs to the rectifying system, which additionally has a low-pressure column 15, which is operated at a pressure of 1.3 to 2 bar, preferably 1.5 to 1.7 bar. High-pressure column 14 and low-pressure column 15 are thermally coupled via a main condenser 16.

Bottom-phase liquid 17 from the high-pressure column 14 is supercooled in a countercurrent heat exchanger 18 against product streams of the low-pressure column and fed into the low-pressure column 15 (line 19). Gaseous nitrogen 20 from the top of the high-pressure column 14 is liquefied in the main condenser 16 against evaporating liquid in the bottom of the low-pressure column 15. The condensate 21 is in part applied as reflux to the high-pressure column 14 (line 22) and in part 23, after supercooling 18, introduced (24) into a separator 25. The low-pressure column 15 is supplied (line 26) with reflux liquid from the separator 25.

Low-pressure nitrogen 27 and impure nitrogen 28, after withdrawal from the low-pressure column 15, are heated in the heat exchangers 18 and 11 to about ambient temperature. The impure nitrogen 30 can be used for regenerating a molecular sieve, which is not shown, for air purification; the low-pressure nitrogen 29 is either removed as product or is used in an evaporative cooler for cooling coolant water.

Oxygen is drawn off as liquid fraction via line 31 from the bottom of the low-pressure column 15, supercooled (18) and introduced (32) into a liquid oxygen tank (first reservoir tank) 33. The liquid oxygen tank 33 is preferably at about atmospheric pressure. Liquid oxygen 34 from the first reservoir tank 33 is pressurized by means of a pump 35 to an elevated pressure of, for example, 5 to 80 bar, depending on the product pressure required. (Obviously, other methods for pressure elevation in the liquid phase can also be used, for example by utilizing a hydrostatic potential or by pressurizing evaporation in a reservoir tank.) The liquid high-pressure oxygen 36 is evaporated in the heat exchanger 12 and drawn off as internally pressurized gaseous product 37.

The part of the gaseous nitrogen from the high-pressure column 14 which is not fed to the main condenser 16 is drawn off via the lines 38, 39 and 40 through the heat exchanger 11 and fed as heat-transport medium to a refrigeration cycle which comprises, inter alia, a two-stage cycle compressor 41, 42 and an expansion turbine 43. In the cycle compressor 41, 42, the nitrogen is compressed from about high-pressure stage pressure to a pressure which corresponds to a nitrogen condensation temperature which is at least about equal to the evaporation temperature of the liquid high-pressure oxygen 36. This pressure—depending on the preset delivery pressure of the oxygen—is, for example, 15 to 60 bar.

A first partial stream 45 of the highly compressed nitrogen 44 is liquefied at least in part, preferably completely or essentially completely, against the evaporating oxygen 36 and is fed into a separator 46.

The second partial stream 59 of the nitrogen compressed in the cycle compressor is fed at the high pressure and at a temperature which is between the temperatures at the hot and cold ends of the heat exchanger 12 to the expansion turbine 43 and there expanded, so as to perform work, to about high-pressure column pressure. The expanded second partial stream 60 is in part recycled through heat exchanger 12 (via 61, 62), and in part recycled through heat exchanger 11 (via 63, 64, 39, 40) to the inlet of the cycle compressor 41, 42.

Liquid nitrogen from the separator 46 can be applied via line 47 as reflux to the high-pressure column 14 and/or can be introduced via line 48 into a second reservoir tank (liquid nitrogen tank 49), which is at a pressure of, for example, 1 to 5 bar, preferably at about atmospheric pressure. The tank can additionally, if appropriate, be fed by excess liquid 50 from the separator 25, which is not required as reflux for the low-pressure column 15. If required, liquid nitrogen can be forced (line 52) into the separator 46 by means of a pump 51.

Some of the nitrogen 53 from line 39 can be taken off from the heat exchanger 11 at an intermediate temperature. This part serves in part as a balance stream 54, using which the efficiency of the main heat exchanger system 11, 12 can be improved, and in part as a further stream 55 of the heat-transport medium, which is expanded to roughly above atmospheric pressure so as to perform work in a second expansion turbine 56. The further stream 57 which has been expanded so as to perform work is heated to about ambient temperature in the heat exchanger 12 and leaves the plant as gaseous product 58.

Liquid oxygen and/or liquid nitrogen can be drawn off as products (the appropriate lines are not depicted in the drawing) from the reservoir tanks 33, 49.

The alternating reservoir storage, in the process ofthe invention, has no interfering effects on the rectification at all; in particular, neither is liquid air fed to the rectification, nor is low-pressure air fed directly into the low-pressure column. As a result, the process is outstandingly suitable for particularly demanding separation tasks, such as the production of argon. For this purpose, a conventional argon rectification can be connected at an intermediate point 66 of the low-pressure column 15, as is indicated in the drawing by the lines shown there. Preferably, for this purpose, one of the processes and apparatuses described in EP-B-377117 or in one of the European Patent Applications 95101844.9 or 95101845.6 having an earlier priority is used for this purpose.

In the example, the first stage 41 of the cycle compressor is also used as a product compressor, by drawing off a product stream 65 at a pressure of preferably 8 to 35 bar, for example 20 bar, between the first and the second stage.

The two fundamental operating modes of a process and an apparatus according to the invention will now be described below. The plant is designed for a defined average rate of pressurized oxygen product. The production can fluctuate about this average value, more precisely between a minimum and a maximum value. To clarify how this fluctuation is effected, in the following numerical examples, the two extreme operating cases ("max", "min") and the operating case of the average pressurized oxygen production ("mean") of a plant which processes 190,000 $m^3$(S.T.P.)/h of feed air are presented. The pressures in this case are

| | |
|---|---|
| high-pressure column 14 | 5.1 bar |
| low-pressure column 15 | 1.3 bar |
| pressurized oxygen 37 | 26 bar |
| inlet of the cycle compressor | 4.8 bar |
| outlet of the cycle compressor | 42 bar |
| liquid oxygen tank 33 | 1.1 bar |
| liquid nitrogen tank | 1.1 bar |

Table 1 relates to the operating mode in which the expansion turbine 43 for the second partial stream 59 is run at constant speed; in the operating mode described in Table 2, the throughput through the cycle compressor 41, 42 is kept constant. Obviously, in the illustrative example, any desired transition between these two operating modes is also possible. In both tables, the rates of the individual streams for the three said operating cases are given in 1000 $m^3$(S.T.P.)/h. The reference numbers in the first column of the table relate to the drawing.

TABLE 1

| (Constant throughput through turbine 43) | Max | Mean | Min |
|---|---|---|---|
| 50 Liquid nitrogen from the main condenser to the liquid nitrogen tank | 1.5 | 1.5 | 1.5 |
| 32 Liquid oxygen from the low-pressure column to the liquid oxygen tank | 36.5 | 36.5 | 36.5 |
| 40 Feed of high-pressure column nitrogen into the cycle | 90 | 90 | 90 |
| 53 Balance stream + further stream (turbine 56) | 30 | 30 | 30 |
| 64 Withdrawal of gaseous nitrogen from the cycle at high-pressure column pressure | 15 | 15 | 15 |
| 47 Liquid nitrogen from the liquid nitrogen tank and from the cycle to the top of the high-pressure column | 54 | 54 | 54 |
| 36 Liquid oxygen to be evaporated | 45 | 35 | 25 |
| 37 Gaseous pressurized product (oxygen) | 45 | 35 | 25 |

TABLE 1-continued

| (Constant throughput through turbine 43) | Max | Mean | Min |
|---|---|---|---|
| 44 Outlet of the cycle compressor | 93 | 83 | 73 |
| 45 First partial stream of the heat-transport medium | 64 | 54 | 44 |
| 59 Second partial stream of the heat-transport medium (turbine 43) | 28.5 | 28.5 | 28.5 |
| 60 | | | |
| 61 Recycling from the second partial stream directly through heat exchanger 12 to the cycle compressor | 13.5 | 13.5 | 13.5 |
| 54 Balance stream | 25 | 15 | 5 |
| 55 Further stream through second turbine 56 | 5 | 15 | 25 |
| 57 | | | |
| 48 Liquid nitrogen from the liquefied first partial stream into the tank | 10 | 0 | 0 |
| 52 Liquid nitrogen from the tank to the high-pressure column | 0 | 0 | 10 |
| 65 High-pressure nitrogen product | 35 | 35 | 35 |

TABLE 2

| (Constant throughput through cycle compressor 41, 42) | Max | Mean | Min |
|---|---|---|---|
| 50 Liquid nitrogen from the main condenser to the liquid nitrogen tank | 1.5 | 1.5 | 1.5 |
| 32 Liquid oxygen from the low-pressure column to the liquid oxygen tank | 36.5 | 36.5 | 36.5 |
| 40 Feed of high-pressure column nitrogen into the cycle | 90 | 90 | 90 |
| 53 Balance stream + further stream (turbine 56) | 30 | 30 | 30 |
| 64 Withdrawal of gaseous nitrogen from the cycle at high-pressure column pressure | 15 | 15 | 15 |
| 47 Liquid nitrogen from the liquid nitrogen tank and from the cycle to the top of the high-pressure column | 54 | 54 | 54 |
| 36 Liquid oxygen to be evaporated | 45 | 35 | 25 |
| 37 Gaseous pressurized product (oxygen) | 45 | 35 | 25 |
| 44 Outlet of the cycle compressor | 83 | 83 | 83 |
| 45 First partial stream of the heat-transport medium | 64 | 54 | 44 |
| 59 Second partial stream of the heat-transport medium (turbine 43) | 18.5 | 28.5 | 38.5 |
| 60 | | | |
| 61 Recycling from the second partial stream directly through heat exchanger 12 to the cycle compressor | 3.5 | 13.5 | 23.5 |
| 54 Balance stream | 25 | 15 | 5 |
| 55 Further stream through second turbine 56 | 5 | 15 | 25 |
| 57 | | | |
| 48 Liquid nitrogen from the liquefied first partial stream into the tank | 10 | 0 | 0 |
| 52 Liquid nitrogen from the tank to the high-pressure column | 0 | 0 | 10 |
| 65 High-pressure nitrogen product | 35 | 35 | 35 |

The diagram is divided in the drawing into two halves by a dashed line. The left half essentially contains the refrigeration cycle and the reservoir tanks; all of the rectification is situated in the right half In the alternating operation of the process and the plant, all of the streams in the right half of the drawing remain completely or essentially unchanged; the fluctuations in the pressurized oxygen production only effect the cycle and the reservoir tanks. This is reflected in the first six lines of the two tables, in which all of the streams are named which cross the dashed line; these have the same throughput in all operating cases, whereas the evaporation rate changes (reference numbers 36, 37). In particular, via line 38, a constant rate of 105,000 $m^3$(S.T.P.)/h of nitrogen is conducted from the high-pressure column 14 into the variable part of the plant which is superimposed in the streams 40 and 53 by a—likewise constant—part (15,000

$m^3$(S.T.P.)/h) of the second partial stream expanded in the turbine 43. Likewise, the withdrawal of liquid oxygen product 31, 32 from the low-pressure column 15 remains constant in all operating cases.

In the numerical example of Table 1, the second partial stream 59, 60 is kept constant. The variation of the first partial stream 45, which is necessary for the evaporation, is accomplished by the corresponding change in the throughput through the cycle compressor (stream 44): if, for example, the production is increased from the average value to the maximum value, the throughput through the cycle compressor increases by about the same amount as the product rate. The additional gas is made available by a corresponding decrease in the gas rate which is withdrawn from the cycle as a further stream 55, 57, 58 through the turbine 56.

The fluctuating rates of liquefied heat-transport medium (first partial stream 45) are buffered by the fact that in the case of above-average production, excess liquid is fed via line 48 to the second reservoir tank 49; conversely, the deficient liquid is replenished at a low product rate via line 52 from the liquid nitrogen tank, in order to keep the reflux rate constant for the high-pressure column 14.

The numerical example of Table 1 is designed so that a mean surplus of liquid is produced, of, in each case, 1500 $m^3$(S.T.P.)/h of oxygen and nitrogen. This can be removed in the form of liquid products continuously, intermittently or else at a variable rate. Moreover, it is also possible in the process to change the average refrigeration performance of the cycle and thus the average rate of liquid products during operation, by appropriately adapting the average speeds of the turbines. The plant can thus be operated particularly flexibly, not only with regard to the internally pressurized product, but also with regard to the liquid production.

In the example of Table 2, instead of the second partial stream, the throughput of the cycle compressor 41, 42 is kept constant.

We claim:

1. A process for the variable production of a gaseous pressurized product (37) by low-temperature of air, in which feed air (10, 13) is fed to a rectifying system (14, 15), a liquid fraction (31, 32, 34) from the rectifying system (14, 15) being buffered in a first reservoir tank (33), the pressure of the liquid fraction (34) being elevated (35) and a variable rate of the liquid fraction (36) being evaporated at the elevated pressure by indirect heat exchange (12) and obtained as gaseous pressurized product (37), in addition, a heat-transport medium being conducted in a refrigerating cycle which has a cycle compressor (41, 42), a first partial stream (44, 45) of the heat-transport medium compressed in the cycle compressor (41, 42) being fed to the indirect heat exchange (12) to evaporate the liquid fraction (36) and being, at least in part, liquefied, a second partial stream (44, 59) of heat-transport medium (44) compressed in the cycle compressor (41, 42) being expanded (43) so as to perform work and liquefied heat-transport medium (45, 48, 52) being buffered in a second reservoir tank (49).

2. A process according to claim 1, wherein a further stream (55) of the heat-transport medium is expanded (56) so as to perform work.

3. A process according to claim 2, wherein the rate of the further stream (55) which is fed to the work-performing expansion (56) is decreased when there is an increased demand for gaseous pressurized product (37).

4. A process according to claim 1, wherein nitrogen (31) from the rectifying system (14, 15) is used as heat-transport medium.

5. A process according to claim 1, wherein the feed air (10) for the rectifying system (14, 15) is cooled in a main heat exchanger system (11, 12), in which the evaporation (12) of the liquid fraction (36) at elevated pressure is also carried out.

6. A process according to claim 5, wherein the main heat exchanger system has a heat exchanger block in which both the cooling of the feed air and the evaporation of the liquid fraction at elevated pressure are carried out.

7. A process according to claim 5, wherein the main heat exchanger system has a first and a second heat exchanger block, in the first heat exchanger block (11) the cooling of the feed air (10) being carried out and in the second heat exchanger block (12) the evaporation of the liquid fraction (36) under elevated pressure being carried out, and the two heat exchanger blocks (11, 12) being coupled by a balance stream (54) which is taken off from one (11) of the two heat exchanger blocks between the hot and cold ends and is fed to the other (12) of the two heat exchanger blocks between the hot and cold ends.

8. An apparatus for the variable production of a gaseous pressurized product by low-temperature separation of air, having a rectifying system (14, 15), into which leads a feed air line (10, 13), having a liquid line (31, 32) for the withdrawal of a liquid fraction from the rectifying system (14, 15) and for its introduction into a first reservoir tank (33), having means (35) for elevating the pressure of the liquid fraction (34), having a heat exchanger (12) for evaporating the liquid fraction (36) at elevated pressure, having a product line (37) for the withdrawal of the evaporated liquid fraction as gaseous pressurized product, having a refrigeration cycle, which has a cycle compressor (41, 42), having a first partial stream line (44, 45), which is connected from the cycle compressor (41, 42) to the heat exchanger (12) to evaporate the liquid fraction (36), having a second partial stream line (44, 59), which leads from the cycle compressor (41, 42) to an expansion engine (43) and having a second reservoir tank (49) for buffering liquefied heat-transport medium (45, 48).

9. A process according to claim 1, wherein the heat-transport medium is a nitrogen enriched fraction from the rectifying system.

10. A process according to claim 1, wherein the rate of throughput of the heat-transport medium and of the cycle compressor (41, 42) are maintained at a constant rate and not in response to any variation in demand for gaseous pressurized product.

11. A process according to claim 10, wherein any variation in the rate of said first partial stream is compensated for by a corresponding adjustment in the rate of the second partial stream.

12. A process according to claim 11 further comprising storing in the second reservoir tank (49) any increased amount of heat-transport medium liquified in the second partial stream.

13. A process according to claim 11 further comprising compensating for any variation in gas rate of the second partial stream by withdrawing varying rates of gas from the cycle.

14. A process added to claim 1, wherein the throughput of the second partial stream is maintained at a constant rate and any variation in the throughput rate of the first partial stream is accompanied by a corresponding variation in the rate of the cycle compressor (41, 42).

15. A process according to claim 1, wherein fluctuations in the first partial stream are compensated for by varying the second partial stream and by varying the throughput of the cycle compressor (41, 42).

* * * * *